United States Patent [19]

Kim

[11] Patent Number: 4,810,227

[45] Date of Patent: Mar. 7, 1989

[54] ARM-BENDING APPARATUS FOR TOYS

[76] Inventor: Sae W. Kim, 46-3, Pyongtack-dong, Pyongtack-si, Kyunggi-do, Rep. of Korea

[21] Appl. No.: 154,889

[22] Filed: Feb. 11, 1988

[30] Foreign Application Priority Data

Dec. 10, 1987 [KR] Rep. of Korea ..... 1987-21832

[51] Int. Cl.[4] ..... A63H 13/00

[52] U.S. Cl. ..... 446/354; 446/358

[58] Field of Search ..... 446/314, 315, 330, 354, 446/355, 356, 357, 358, 359, 365, 371, 375, 376

[56] References Cited

U.S. PATENT DOCUMENTS 2,585,467 2/1952 Huth ..... 446/358
4,186,517 2/1980 Kuhn et al. ..... 446/330
4,341,036 7/1982 Yeu ..... 446/373
4,571,208 2/1986 Saigo et al. ..... 446/322

*Primary Examiner*—Robert A. Hafer
*Assistant Examiner*—Michael Brown
*Attorney, Agent, or Firm*—Darby & Darby

[57] ABSTRACT

An arm-bending apparatus for toys is disclosed which can allow toys to embrace their user or hang on their user's neck in response to their user's embrace. The apparatus desirably includes a motorized arm-bending means installed inside the toy's body and linked to its arms by strings, and a switching means attached to the bosom or neck of the toy's body likely to have contact with the user's body. When the toy is embraced or released, the switching means controls the operation of the motorized arm-bending means, causing the arms to be bent or spread out respectively.

11 Claims, 2 Drawing Sheets

ARM-BENDING APPARATUS FOR TOYS

BACKGROUND OF THE INVENTION

1. Field of the Invention

The present invention relates to an arm-bending apparatus for toys, and in particular to an arm-bending apparatus for toys shaped like human beings or animals such as bears, monkeys, etc. which can take something into their arms or hand about their user's neck.

2. Description of the Prior Art

Conventional toys are designed so as to produce voices of animals or simply repeat certain movements by the operation of clockworks or electronic devices installed therein. Therefore, it is highly desirable that such toys can pose or act in response to their user's action.

SUMMARY OF THE INVENTION

It is an object of the present invention to provide an arm-bending apparatus for toys which can allow such toys to embrace their user or hang on their user's neck in response to their user's embrace.

In order to achieve the above object, the present invention comprises a motorized arm-bending means installed inside a toy's body and linked to its arms by strings, and switching means attached to the bosom or other parts of the toys's body likely to have contact with the user's body. Thus, if the toy is embraced by the user, the switching means is switched to a certain condition and accordingly, the arm-bending means operates causing the arms to bend and hold or hang on to the user. Then, if the toy is released from the user's embrace, the switching means returns to its original condition and the arm-bending means operates in reverse making the arms spread out.

BRIEF DESCRIPTION OF THE DRAWINGS

The present invention will now be described by way of illustrative example with reference to the accompany drawings, in which.

DETAILED DESCRIPTION OF THE PREFERRED EMBODIMENTS

Figure 1:
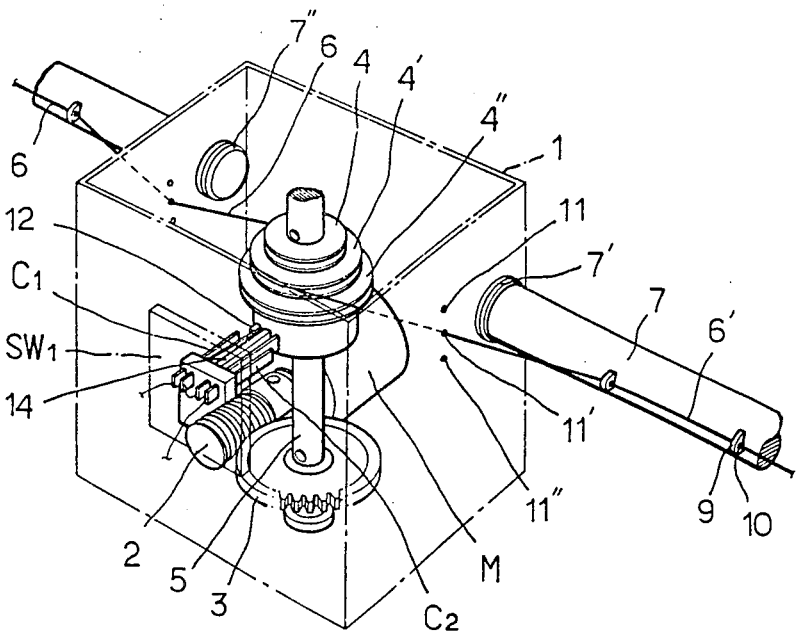
FIG. 1 is a perspective view showing one embodiment of the present invention.

Referring to FIG. 1, there is shown one embodiment of the present invention.

The arm-bending means comprises a motor M installed inside the support 1 of the apparatus, a worm 2 and a worm gear 3, three bobbins 4, 4', 4'' having diameters different from each other and being also connected to the shaft 5 of the worm gear 3, two arms 7 joined with joining members 7' 7'' of the support 1, and strings 6, 6' wound on one of the bobbins 4, 4', 4'' from different directions and respectively linked to each of the arms 7 through one of the vents 11, 11', 11'' in the support 1. Preferably, each arm 7 comprises a plurality of guide members 9 which have openings 10 for each of the strings 6, 6' to pass through.

In preferred embodiments, the arms 7 are made of elastic materials such as synthetic resin, soft rubber, etc. and the strings 6, 6' are made of a fiber similar in quality to fishlines.

The switching means, on the other hand, comprises a protrusion 12 formed on the shaft 5 of the worm gear 3, first switch $SW_1$ and second switch $SW_2$.

The first switch $SW_1$ has contacts $E_1$, $E_2$, $E_3$ which are brought in contact with contacts $b_1$, $b_2$, $b_3$ or with contacts $a_1$, $a_2$, $a_3$ alternately by the change in pressure on them when the toy is embraced or released, and changes the motor's rotating direction by converting the polarity of DC power supplied to the motor M depending on the contact conditions of the contacts $E_1$, $E_2$, $E_3$.

The second switch $SW_2$ has two pairs of contacts $d_1$, $C_1$ and $d_2$, $C_2$ respectively being electrically connected between the first switch $SW_1$ and the motor M and being alternately opened by the protrusion 12 since the shaft 5 rotates clockwise or counterclockwise.

Figure 2:
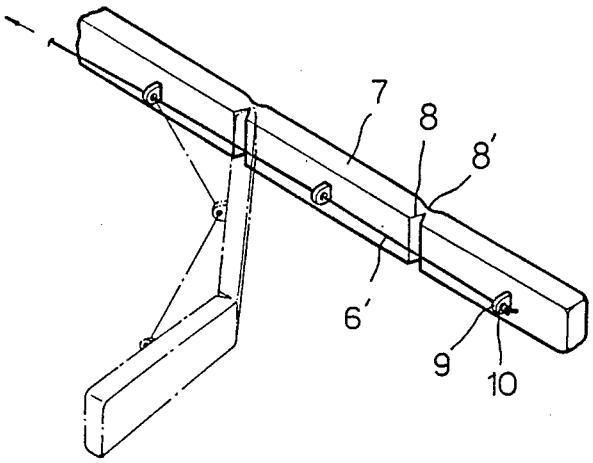
FIG. 2 is a perspective view of another embodiment of the arm-bending means shown in FIG. 1.
Figure 3:
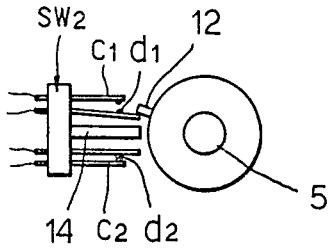
FIG. 3 is a plan view of the second switch of the switching means shown in FIG. 1.
Figure 4:
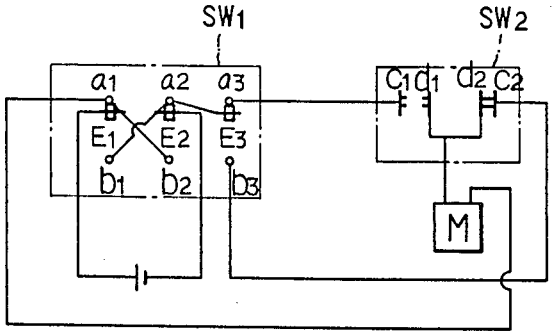
FIG. 4 is a schematic circuit diagram of the switching means shown in FIG. 1.

FIG. 2 shows another embodiment of the arm-bending means. In the embodiment, each arm 7 has at least one set of bend portions 8, 8' formed therein, which facilitate the bending of the arm 7 toward the imaginary lines in FIG. 2.

Figure 5:
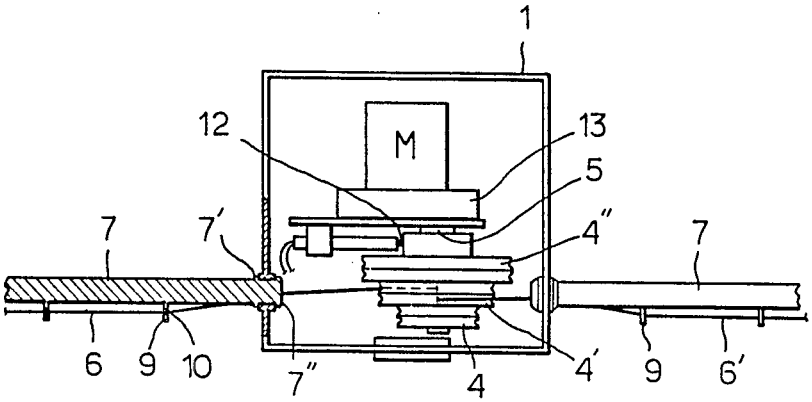
FIG. 5 is a plan view of still another embodiment of the armbending means shown in FIG. 1.

FIG. 5 shows still another embodiment of the arm-bending means. In this embodiment, the bobbins 4, 4', 4'' are connected to a speed reducer 13 which reduces the speed of the motor M instead of the worm 2 and the worm gear 3.

Referring now to FIG. 1 to 5, it can be seen that the contacts $E_1$, $E_2$, $E_3$ of the first switch $SW_1$ are protruded from the toy's body by springs (not illustrated in the drawings) and are brought into contact with the contacts $a_1$, $a_2$, $a_3$ respectively. Also, the contacts $d_2$ and $C_2$ of the second switch $SW_2$ are closed with each other making each arm 7 spread out.

If the user embraces the toy or presses the toy's bosom or neck on something sufficiently hard such as a post, the contacts $E_1$, $E_2$, $E_3$ of the first switch $SW_1$ protruded from the toy's bosom or neck are pressed and brought into contact with the contacts $b_1$, $b_2$, $b_3$ respectively. Accordingly, the motor M is supplied with the DC power through the contacts of the first switch $SW_1$ and the contacts $d_2$, $C_2$ of the second switch $SW_2$, and rotates clockwise, which causes the worm 2, the worm gear 3 and the shaft 5 to rotate, coincident with the rotation of the protrusion 12 on the shaft 5, thereby causing the contact $d_1$ to touch the contact $C_1$. With the shaft 5 rotating continuously in such a way, the bobbins 4, 4', 4'' also rotate, causing the strings 6, 6' linked thereto to wind, thereby causing each arm 7 of the toy to bend in a suitable way for embracing the user.

When the shaft 5 has almost completed one revolution, the protrusion 12 pushes the contact $d_2$, causing the contact $d_2$ to be split from the contact $C_2$, thereby causing the DC power being supplied to the motor M to be stopped after which the revolution ceases and each arm 7 is left bent.

When the toy with its arms 7 bent is released from the user's embrace, the contacts $E_1$, $E_2$, $E_3$ of the first switch $SW_1$ return to their original position and touch the contacts $a_1$, $a_2$, $a_3$ respectively, thereby the polarity of the DC power supplied to the motor M through the contacts of the first switch $SW_1$ and the closed contacts $d_1$, $C_1$ of the second switch $SW_2$ are converted, which causes the motor M to rotate counterclockwise. Thus, the bobbins 4, 4', 4'' also rotate in a counter direction, causing the wound strings 6, 6' to be released, and also causing each arm 7 to spread out and to return to its original position by its own elasticity. Also, the protrusion 12 on the shaft 5 rotates in a counter direction and departs from the contact $d_2$ causing the contact $d_2$ to touch the contact $C_2$. When the shaft 5 has almost completed one revolution in such a revolving condition, the protrusion 12 makes the contact $d_1$ separate from the contact $C_1$, thereby stopping the DC power supplied to the motor M. Then, the rotation ceases and each arm 7 remains in its original spread condition.

A limiting bar 14 of the second switch $SW_2$ prevents excessive rotation of the protrusion 12 owing to the inertial force of the motor M after the DC power supplied to the motor M is disconnected.

In the preferred embodiments of the present invention, the bending degree of the arm 7 can be adjusted in accordance with the kinds and objects of toys by a change of the diameters of the bobbins 4, 4', 4''. For instance, in order to achieve a greater bending of the arm 7, the strings 6, 6' are wound around the large-diameter bobbin 4'' and linked to the arm 7 through the vent 11''. However, to achieve a slight bending, the strings 6, 6' are wound around the small-diameter bobbin 4 and linked to the arm 7 through the vent 11.

In the illustrative embodiment of FIG. 2, the sets of bent portions 8, 8' formed in the arm 7 facilitate the bending of the arm 7 to a constant degree and could be very valuable if applied to toy robots.

On the other hand, the hanging-on action or pose of the toy can be obtained by placing the guide members 9 on the upper side of the arm 7, since they facilitate the bending of the arm 7 upwards when the strings 6, 6' are sound by the rotation of the bobbins 4, 4', 4''.

In the embodiment of FIG. 5, a speed reducer 13 using spur gears with a large gear ratio is employed as the power-transmission means, instead of the worm 2 and the worm gear 3.

Aside from the above-described embodiments, any other disired power-transmission means may, of course, be employed. Also, the first switch $SW_1$ of the contact type may be substituted for with an electronic switch comprising an electronic sensing circuit.

While the present invention has been described and illustrated herein with reference to the preferred embodiments thereof. It will be understood by those skilled in the art that various changes in form and details may be made therein without departing from the spirit and scope of the invention.

What is claimed is:

1. An arm-bending apparatus for toys comprising:

a support having a pair of vents;

two arms;

a motorized arm-bending means having a motor and a speed reducing means coupled thereto, at least one bobbin fitted on said speed reducing means, joining members for joining said arms to said support, and strings wound on said bobbin from different directions respectively and linked to each of said arms through a respective vent in said support; and switching means comprising a protrusion formed on the shaft of said speed reducing means, a first switch having contacts for converting the polarity of DC power to said arm-bending means for changing direction of rotation of said motor, and a second switch responsive to rotation action of said protrusion and having pairs of contacts connected between said first switch and said motorized arm-bending means which alternately open and close as said protrusion is caused to rotate by said speed reducing means.

2. An arm-bending apparatus as claimed in claim 1, wherein the contacts for said first switch are either open or closed as determined by the change in pressure thereon when a toy is embraced or released.

3. An arm-bending apparatus as claimed in claim 1, wherein the contacts for said second switch are alternately open or closed as determined by the position of said protrusion when the shaft of said speed reducing means has almost completed one revolution clockwise or counterclockwise.

4. An arm-bending apparatus as claimed in claim 1, wherein said arms are made of soft rubber.

5. An arm-bending apparatus as claimed in claim 1, wherein said arms are made of synthetic resin.

6. An arm-bending apparatus as claimed in claim 1, wherein three bobbins have diameters different from each other are provided on the shaft of said speed reducing means to wind said strings around one of said bobbins alternatively.

7. An arm-bending apparatus as claimed in claim 1, wherein each of said arms comprises a plurality of guide members having openings for said strings to pass therethrough.

8. An arm-bending apparatus as claimed in claim 7, wherein said guide members are placed on the upper sides of said arms so that said arms are bent upwards when said strings are wound.

9. An arm-bending apparatus as claimed in claim 1, wherein each of said arms has at least one pair of bent portions formed therein.

10. An arm-bending apparatus as claimed in claim 1, wherein said speed reducing means is formed by a worm and a worm gear.

11. An arm-bending apparatus as claimed in claim 1, wherein said speed reducing means is formed by spur gears with large gear ratios.

* * * * *

UNITED STATES PATENT AND TRADEMARK OFFICE

CERTIFICATE OF CORRECTION

PATENT NO. : 4,810,227

DATED : March 7, 1989

INVENTOR(S) : Sae W. Kim

It is certified that error appears in the above—identified patent and that said Letters Patent is hereby corrected as shown below:

On the title page, Item [73]
Assignee

Dong-Il Trading Co., Ltd.
Seoul, Korea (part interest)

Signed and Sealed this

Ninth Day of March, 1993

*Attest:*

STEPHEN G. KUNIN

*Attesting Officer*

*Acting Commissioner of Patents and Trademarks*